United States Patent [19]

Memminger et al.

[11] Patent Number: 4,706,476

[45] Date of Patent: Nov. 17, 1987

[54] YARN SUPPLY APPARATUS FOR TEXTILE MACHINES ESPECIALLY CIRCULAR KNITTING MACHINES

[75] Inventors: Gustav Memminger, Heideweg 65, D-7290 Freudenstadt; Erich Roser, Bermatingen; Falk Kühn, Kiebingen, all of Fed. Rep. of Germany

[73] Assignee: Gustav Memminger, Freudenstadt, Fed. Rep. of Germany

[21] Appl. No.: 910,809

[22] Filed: Sep. 22, 1986

Related U.S. Application Data

[63] Continuation of Ser. No. 726,070, Apr. 23, 1985, abandoned.

[30] Foreign Application Priority Data

May 2, 1984 [DE] Fed. Rep. of Germany ..... 3416195

[51] Int. Cl.[4] ..... D04B 15/48; D04B 35/14

[52] U.S. Cl. ..... 66/132 R; 66/125 R; 66/146; 242/47.01

[58] Field of Search ..... 66/163, 9 B, 132 R, 66/125 R, 146; 242/47.01; 139/452

[56] References Cited

U.S. PATENT DOCUMENTS

| | | | |
|---|---|---|---|
| 2,227,355 | 12/1940 | Lawson | 66/132 R X |
| 2,227,356 | 12/1940 | Lawson | 66/132 R X |
| 3,083,924 | 4/1963 | Vossen et al. | 66/132 R X |
| 3,093,330 | 6/1963 | Schmidt | 242/45 |
| 3,419,225 | 12/1968 | Rosen | 66/125 R X |
| 3,625,444 | 12/1971 | Hatay | 66/125 R X |
| 4,007,607 | 2/1977 | Christiansen et al. | 66/132 R X |
| 4,271,687 | 6/1981 | Memminger et al. | 242/47.01 X |
| 4,349,161 | 9/1982 | Carlsson et al. | 242/47.01 |

FOREIGN PATENT DOCUMENTS

| | | | |
|---|---|---|---|
| 1069813 | 11/1959 | Fed. Rep. of Germany | 66/125 R |
| 1635899 | 6/1961 | Fed. Rep. of Germany . | |
| 1833298 | 6/1961 | Fed. Rep. of Germany . | |
| 1585198 | 12/1970 | Fed. Rep. of Germany . | |
| 2350979 | 4/1975 | Fed. Rep. of Germany . | |
| 3416195 | 11/1985 | Fed. Rep. of Germany . | |
| 2218414 | 10/1974 | France | 66/132 R |
| 44941 | 11/1985 | German Democratic Rep. . | |
| 965904 | 8/1964 | United Kingdom . | |
| 1432973 | 4/1976 | United Kingdom . | |
| 2062700 | 5/1981 | United Kingdom . | |
| 2127046 | 4/1984 | United Kingdom . | |

*Primary Examiner*—Wm. Carter Reynolds

*Attorney, Agent, or Firm*—Frishauf, Holtz, Goodman & Woodward

[57] ABSTRACT

A yarn feeding apparatus for yarn-processing textile machines such as circular knitting machines has a feed element which advances the yarn with its circumference. The feed element is rotatably supported on a holder which is arranged to be secured on a carrier and has yarn guide and/or monitoring devices for the yarn being fed to and/or delivered by the feed element. The feed element is driven by a regulated electric motor disposed on the holder. To provide for yarn feeding apparatus which is both compact and inexpensive, the electric motor is a stepping motor coupled to at least one yarn feed element, which advances a yarn in a slip-free manner with its circumference, each element having its own yarn guide and monitoring devices associated with it.

21 Claims, 6 Drawing Figures

YARN SUPPLY APPARATUS FOR TEXTILE MACHINES ESPECIALLY CIRCULAR KNITTING MACHINES

This application is a continuation of application Ser. No. 726,070, filed 4-23-85, now abandoned.

The invention relates to a yarn feeding apparatus for yarn-processing textile machines such as circular knitting machines. The apparatus has a feed element which advances the yarn with its circumference and is rotatably supported on a holder. The holder is arranged to be secured on a carrier and bears yarn guide and/or monitoring devices for the yarn that is being fed to or delivered by the feed element. The feed element is driven by a regulated electric motor which is disposed on the holder.

In order to attain slip-free, uniform advancement of the yarns to the individual knitting systems of multi-system circular knitting machines, it is known for each of the individual knitting systems to be associated with its own yarn feed element, in the form of a drum, which is surrounded several times by the yarn that is to be advanced, thus forming a coil, or windings, of yarn. The speed of yarn travel is the same for both the yarn moving toward the feed drum and the yarn leaving this drum. All the yarn feed drums are driven by an endless belt, which may be formed as a perforated or toothed belt, revolving around the circumference of the machine. Because of the belt guiding devices associated with it, this endless belt revolving around the circumference of the machine is expensive.

Furthermore, driving all these yarn feed drums by means of an endless belt dictates that all the yarn feed elements must feed exactly the same amount of yarn. Under certain operating conditions, however, such as when knitting patterned goods, different amounts of yarn are used at the various knitting feeds. These yarn feed elements are therefore unsuitable for such uses. Instead, reserve-capacity feedwheels must be used, which carry a spool of yarn on a feed drum, the yarn being unwound over head from the spool. The size of this spool is kept within two threshold values by switching the drive of the feed drums on and off. When unwinding the yarn over head, however, the yarn tension at the knitting location can be regulated by only one yarn brake; with certain yarns, this involves difficulties and is inaccurate.

In reserve-capacity feedwheels of this kind, it is also known (see U.S. Pat. No 3,419,225, Rosen, to which Fed. Rep. German examined patent application DE-AS 16 35 899 corresponds) to equip each yarn feed drum with its own electric motor drive embodied in such a way that the cylindrical spool body of the feed drum is the rotor of an electric motor supported in the interior of the spool body; the motor is supplied with electric current from a current source under the control of a microswitch. A disk which scans the yarn spool controls the microswitch in such a way that the microswitch turns the electric motor on or off if the spool either exceeds, or becomes smaller than, a certain size. It is not possible in this way to regulate the circumferential speed of the spool body.

This kind of regulation of the speed of a yarn storage drum driven by an electric motor is attainable in a yarn storage and feeding apparatus (West German examined patent application DE-AS No. 23 50 979) arranged such that in the operating speed range, the electric motor has a virtually constant torque, of a magnitude such that the remaining torque used for driving the yarn storage drum, and hence the drum speed, are regulated in accordance with the size of the spool and with the variable force the electric motor must exert so as to displace the spool axially. Hence this apparatus is based on the principle of exploiting the variable sliding resistance of the yarn spool on the yarn storage drum as a criterion for exerting direct influence on the speed. However, this sliding resistance is dependent on the type and characteristics of yarn being fed. Aside from that, this kind of regulation is inherently only very coarse.

Finally, a yarn feeding apparatus for circular knitting machines is also known (East German patent DD-PS No. 44 941) in which the variation of the yarn requirement is programcontrolled at each knitting feed. To this end, the yarn feeding apparatus comprises a roller which transports the yarn wound about it or resting on a portion of its circumference and which is driven directly by an electric motor or by the rotor thereof. The roller is formed with a surface that transports the yarn in a slip-free manner, while means are provided which automatically synchronize the speed of the motor with that of the needle cylinder. What is disclosed here is only the prinicple of the yarn feeding apparatus; no details of how this apparatus is supposed to be structured are known.

The yarn feeding apparatus mentioned, having individual electric motor drive of the yarn feeding element, have the fundamental advantage that they dispense with drive belts that extend over the circumference of the entire circular knitting machine. On the other hand, however, the cost of these yarn feeding apparatus is still relatively high, and in particular they require a relatively large amount of space, which are particularly significant disadvantages in machines with a high number of systems (up to 144 systems).

THE INVENTION

Accordingly, it is an object to devise a yarn feeding apparatus, in which the yarn feed elements associated with the various knitting feeds have their own electric motor drive mechanisms, which can be used in many applications; enable accurate yarn feeding, adapted to the given conditions of various applications, in an individually triggerable and regulatable manner, and have low cost and little space requirement.

Briefly, the electric motor of the yarn feeding apparatus is a stepping motor; and at least one further electric-motor-driven feed element advancing the yarn in a slip-free manner with its circumference is disposed on the holder, having its own yarn guide and monitoring devices associated with it and located on the holder.

Particularly favorable conditions are attained, in terms of the space required in the circumferential direction of the circular knitting machine, if the two feed elements are located on opposite sides of the holder. In a preferred embodiment, the arrangement may be such that both feed elements driven by the common stepping motor are disposed coaxially with the shaft of the stepping motor, and at least one of them is coupled with the motor shaft via a selectively actuatable coupling. This coupling may be electrically triggerable, so that it can be triggered in accordance with a program from a central command unit.

Naturally it is also conceivable in principle for the yarn feeding apparatus to be formed such that each feedwheel, or a plurality of feed elements disposed on a common motor shaft, is driven by its own stepping motor disposed on the holder, this motor having correspondingly small dimensions.

The novel yarn feeding apparatus has the advantage of a very simple, space-saving structure, because all that is required for feeding at least two yarns are one holder and the space needed for securing it on the circumference of the circular knitting machine. The feed elements associated with one holder may be driven in common or in alternation, so that with one yarn feeding apparatus, it is also possible to supply multiple yarns to one knitting feed (for forming plating stitches) or to supply yarn to a so-called striper, or circular striping attachment.

DRAWINGS, which show:

FIG. 1, a yarn feeding apparatus according to the invention, seen in perspective;

FIG. 2, a yarn feeding apparatus according to the invention in an embodiment slightly modified as compared to FIG. 1, seen in plan view and partially cut away;

FIG. 3, a yarn feeding apparatus in an embodiment similar to FIG. 2 with yarn guide devices associated with it, seen in a side view;

FIG. 4, the yarn feeding apparatus according to FIG. 3 showing the yarn feed disk in a position that is pivoted away from the position of FIG. 3, seen in a side view;

FIG. 5, the yarn feeding apparatus in an embodiment similar to FIG. 2, partially cut away and seen from the front; and FIG. 6, a block circuit diagram of a control circuit for a yarn feeding apparatus according to the invention.

DETAILED DESCRIPTION

Figure 1:
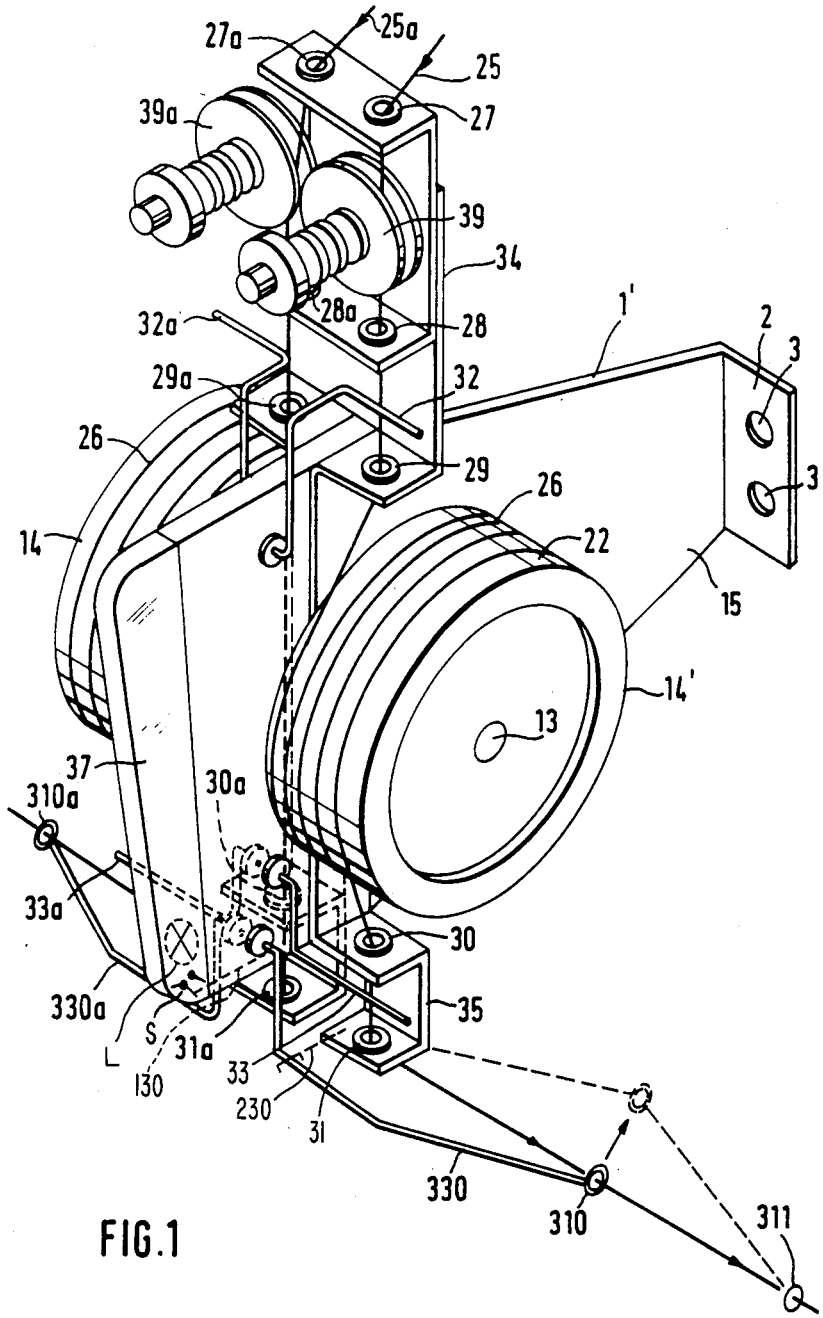
Figure 2:
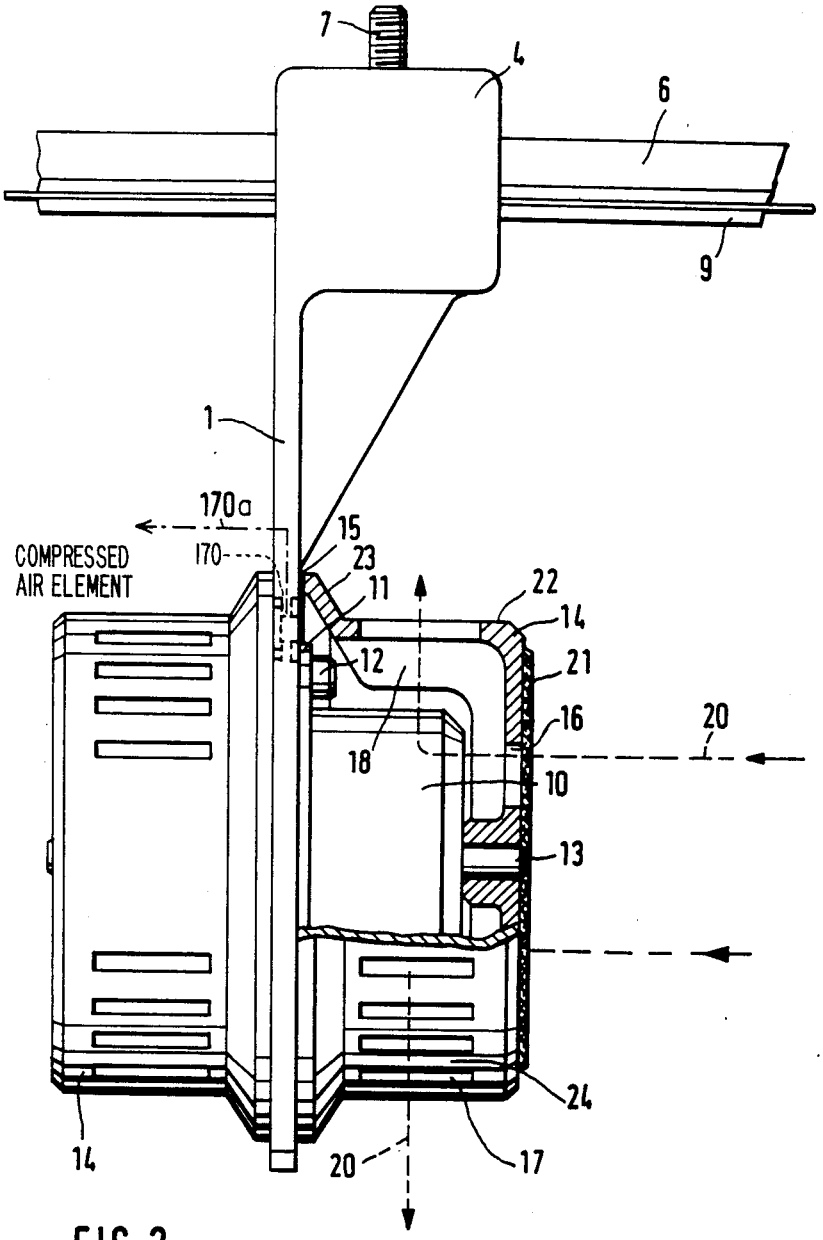

The yarn feeding apparatus shown in FIGS. 1, 2 in two embodiments which differ from one another only in a few structural details has a holder 1', which bears a device for securing it to a part of a frame, such as a yarn rack of a yarn-using textile machine, or on a stationary bobbin creel. In the embodiment shown in FIG. 1, this securing device comprises a part 2 provided on the holder 1' and bent at right angles, having two securing holes 3 formed therein. In the embodiment of FIG. 2, the holder 1 is provided with a bracketlike part 4 on its end in order that it can be secured; the part 4 defines a groove 5 open at the rim (see FIG. 3), with which it can be pushed over a securing ring shown at 6, on which it can be firmly clamped by means of a locking screw 7. Protruding into the opening 5 that is open at the rim are contact pins 8, which when the holder 1 is firmly clamped to the yarn rack 6 are in contact, in a manner known per se, with electric conductors 9.

An electric motor 10 formed as an autosynchronous or stepping motor is secured on the holder 1 or 1'. On its end face, the stepping motor has an attachment flange 11 which is firmly screwed by means of attachment screws 12 to a corresponding face of the holder 1 or 1', against which it rests flush. The arrangement is such that, as shown in FIGS. 1 and 2, the motor shaft 13 extends substantially horizontally when the holder 1 or 1' is mounted in the operational position.

Two feed elements in the form of two cup-shaped feed disks or drum structures 14 (FIG. 2) of plastic or light metal are mounted on the motor shaft 13 in a rotationally secured manner, and one of them, together with the adjoining face 15 of the holder 1 or 1', surrounds the stepping motor 10 on all sides and closes it off from the outside. Each feed disk 14 has a relatively large diameter, as compared with the diameter of yarn feed drums of known positive or reserve-capacity feedwheels. It is provided with slit-like ventilation openings 16, 17, of which the ventilation openings 16 are disposed in the bottom face and the ventilation openings 17 are disposed in the circumferential face of the feed disk 14, while in the interior the feed disk is provided with fan blades 18. In this manner, a flow of cooling air indicated at 20 is generated, which passes through the interior of the feed disk 14 and serves to cool the stepping motor 10. In order to prevent fluff and lint from getting into the interior of the feed disks 14, the ventilation openings 16 are covered by a dust filter indicated at 21. The ventilation openings 17 may also be omitted, see FIG. 1- so that the feed disks 14' have a smooth surface. Also, at least one air flow opening 170 may be provided in the holder 1, inside the area covered by the cup-like feed disk 14, and an air hose shown schematically by chain dotted line **170*a* is coupled thereto in any well known manner. Hose 170*a*** leads to an element that uses compressed air may be connected to the air flow opening.

Each feed disk 14 or 14' has a substantially cylindrical or circumferential zone 22, which is adjoined at its end by a substantially frustoconical zone 23, in a such a manner that the feed disk 14 or 14' widens outwardly toward its rim in funnellike fashion. The cylindrical circumferential face 22 of disk 14 is interrupted by the slit-like ventilation openings 17, between which individual webs 24 are formed, on which the yarn 25 that is to be fed rests with individual windings of its yarn spool 26, shown only in FIG. 1. The number of windings of the spool or yarn reserve 26, which may be kept relatively small given the large diameter of the feed disk 14, 14' as mentioned above, is selected such that as the feed disk 14, 14' revolves, a slip-free advancement of the yarn 25 or **25*a* (FIG. 1**) is effected.

Yarn guide and monitoring devices associated with each of the feed disks 14, 14' are disposed on the holder; in the embodiment shown in FIG. 1, these devices comprise three feed eyelets 27, 28, 29 (and **27*a*, 28*a*, 29*a*), two delivery eyelets 30, 31 (and 30*a*, 31*a*) and two yarn feeler arms 32, 33 (or 32*a*, 33*a*). The yarn feed eyelets 27–29 (and 27*a*–29*a*) are disposed, coaxially with one another and aligned substantially at right angles to the axis of the motor shaft 13, on a bracket 34 secured to the holder 1, 1'. The same applies to the two delivery eyelets 30, 31 as well, which are mounted on a corresponding holder bracket 35. After the delivery eyelet 31, the yarn 25, 25*a* passes through an eyelet 310 (and 310*a*) on the end of a flexible, additional yarn feeler arm 330 (and 330*a*), which is likewise pivotally supported on the holder 1, 1' and the purpose of which will be explained below. An eyelet 311 also is provided which is stationary and is located following the eyelet 310**.

Each of the feed disks 14, 14' may also have two or more of the described yarn guide and monitoring devices associated with it, in order to store and transport correspondingly many separate yarns beside one another on the circumfernece of its feedwheel 14, 14'. This embodiment is of particular interest in producing technical goods that are unpatterned; as compared with the embodiment shown in FIG. 1, it makes it possible to achieve the same output with half as many, or a correspondingly lesser number, of feedwheels.

A transparent covering cap 37 (FIG. 1) is locked into place on the holder 1, 1', and an indicator lamp L shown schematically only, which signals an interruption in operation, is housed in this cap. All these electrical devices are connected to the contact pins 8 shown in FIG. 3, by way of which, as already noted, the supply of current is effected.

A yarn brake 39, 39*a* is located between the two feed eyelets 27, 28 (or 27*a*, 28*a*), on the bracket 34, making it possible to adjust the feed tension of the yarn to a value appropriate for forming the spool or winding 26.

The yarn 25 or 25*a* arriving via the feed eyelets 27–29 meets the frustoconical face 23 (FIG. 2), on which the windings that continuously form are automatically advanced downward onto the substantially cylindrical face zone 22. From this face zone 22, the yarn 25, 25*a* then moves away via the delivery eyelets 30, 31 (30*a*, 31) at the same speed at which it is fed to the respective feed disk 14. The shaft 13 of the stepping motor 10 is aligned substantially horizontally, while the course of the yarn, as shown, is substantially vertical.

Figure 3:
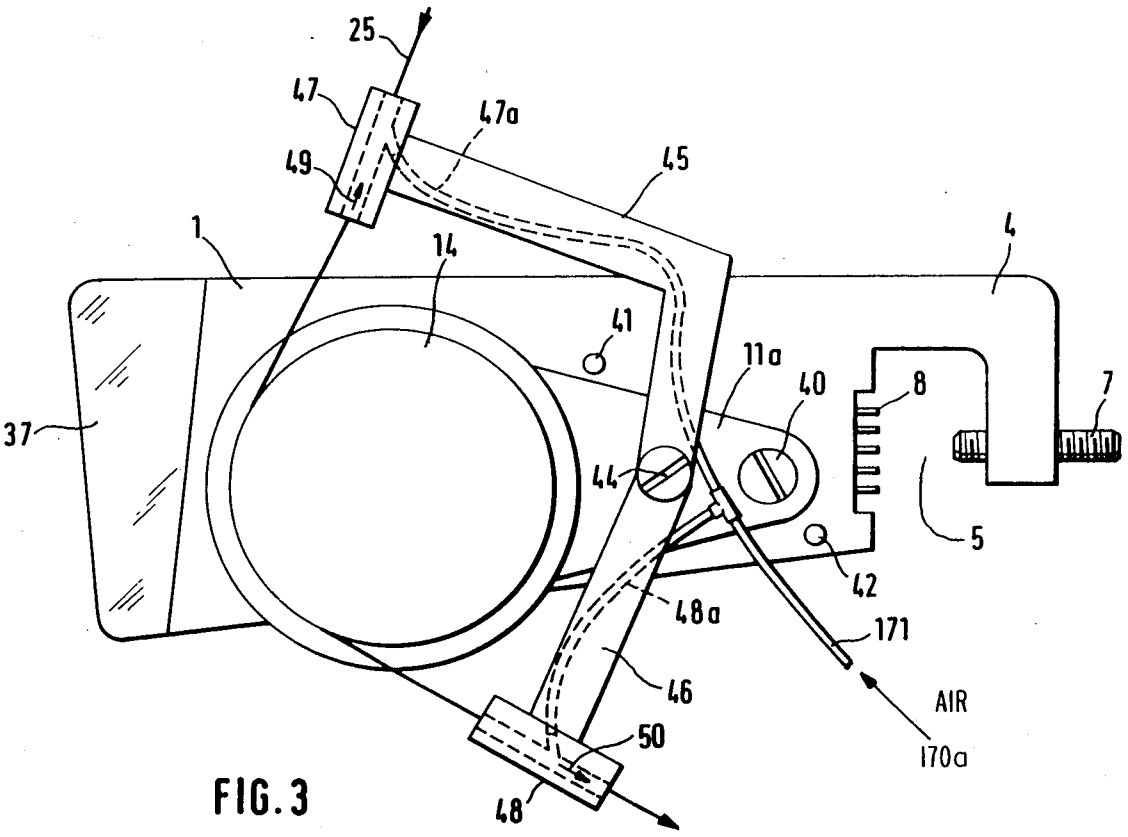
Figure 4:
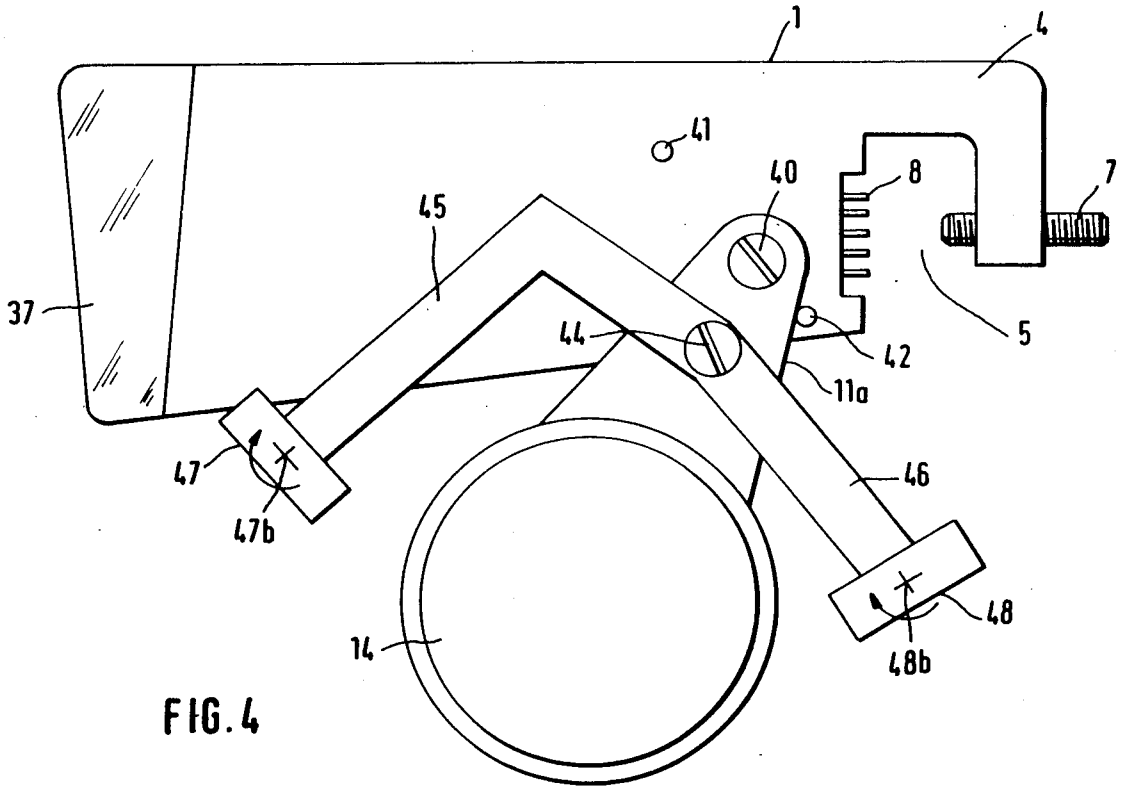

The embodiment according to FIGS. 3, 4 is substantially similar to that of FIG. 2; identical elements are therefore provided with the same reference numerals.

The stepping motor 10 of FIGS. 3 and 4 bearing the feed disks 14, 14' is provided with a longer flange 11*a* protruding between the feed disks 14, 14' and supported on the holder 1, 1' beside the feed disks 14, 14' on a pivot bearing 40 that is axially parallel to the axis of the motor shaft 13. Thus the feed disks 14, 14' can be pivoted, together with the stepping motor 10, out of the position shown in FIG. 3 and into the position shown in FIG. 4, this position being defined by a stop pin 42.

A locking device not shown in further detail is associated with the pivoting bearing 40 and by this means the bracket 11a can be releasably locked in the two positions of FIGS. 3 and 4.

Especially in circular knitting machines having a high number of feeds, the yarn feeding apparatuses are mounted very close to one another on the yarn rack 6, which impedes access to the yarn feeding apparatuses, especially when threading the yarn. The pivotability of the feed disk 14, 14' described in conjunction with FIGS. 3, 4 makes it possible to put the feed disk 14, 14' as needed into an easily accessible position for threading as shown in FIG. 4 and then return it to the operating position shown in FIG. 3.

Alternatively to being pivotably disposed, the feed disks 14, 14' could also be supported such that they are longitudinally or telescopingly supported on the holder 1, 1' or are adjustable in some other manner, including being adjustable individually.

The pivotable flange 11a can be monitored, in its pivoted position, by means of an electric switch disposed on the holder 1, 1'; the actuation device of the switch is formed by the stop pin 42. This protects against unintentional switching ON of the machine. Furthermore, the malfunction indicator lamp L beneath the covering 37 should also light up in this position.

In this embodiment, two arms 45, 46 are supported adjustably, by means of a locking screw 44, on both sides of the elongated flange 11*a*; at their ends they have guide devices for the yarn 25 and 25*a*, which may be way of example be embodied as yarn eyelets and may be adjustable about their securing axes 47*a*, 48*a* so that they can operate in both rotational directions of the yarn disk 14, 14' and in order to assure a tangential yarn feeding and facilitate feeding the yarn by hand. In the illustrated embodiment, these yarn guide devices comprises compressed-air-operated injectors 47, 48, each injector 47 of which, as indicated by an arrow 49, acts as a yarn brake, while each injector 48, as indicated by an arrow 50, comes into play so as to advance the yarn. The supply of compressed air in the injectors is effected via the air hoses 47*a*, 48*a* shown in FIG. 4, either from a closed circular air line, not shown, or else the cooling air emerging from the air flow opening 170 and from hose 170*a* can be collected and passed via the air hoses 47*a*, 48*a* to the injectors 47, 48 (see FIG. 2).

By means of the injectors 47, 48, the yarn 25 or 25*a* is not only guided but also braked or advanced substantially without being touched, and fluff and the like is automatically blown away from the yarn. At other parts of the yarn feeding apparatus as well, the cooling air emerging from the ventilation openings 17 of the yarn disks 14 prevents fluff and dust from building up.

In the embodiment shown in FIG. 5, the arrangement is again such that a separate feed disk 14,514 is mounted on the shaft 13 of the stepping motor 10 shown in FIG. 2, on both sides of the holder 1; the feed disks are substantially identical to that shown in FIG. 2. Identical elements are therefore provided with the same reference numerals. Each of the feed disks 14,514 has its own yarn guide and monitoring devices associated with it, of which only the feed and delivery eyelets 29, 29*a* and 30, 30*a* mounted on a bracket 34 or 34*a* and 35 or 35*a* are shown.

In this embodiment in particular, at least one of the two feed disks 514 is formed such that it is releasably coupled to the common stepping motor 10, so that for instance if there is a disruption, perhaps while winding yarn onto a spool by hand, the other feed disk 14 will not be affected. An electromagnetic coupling is used shown at 100. It can be triggered via an electrical signal, which is delivered via slip rings 101 controlled by a switch 5, as will appear.

In a further embodiment, not otherwise shown, each feed disk 14 be assigned its own stepping motor 10; the connection between a respective disk and motor may need not have a coupling. The advantages here, also are the common holder 1, 1' the common indication lamp beneath the covering 37, and the narrow structure.

Figure 6:
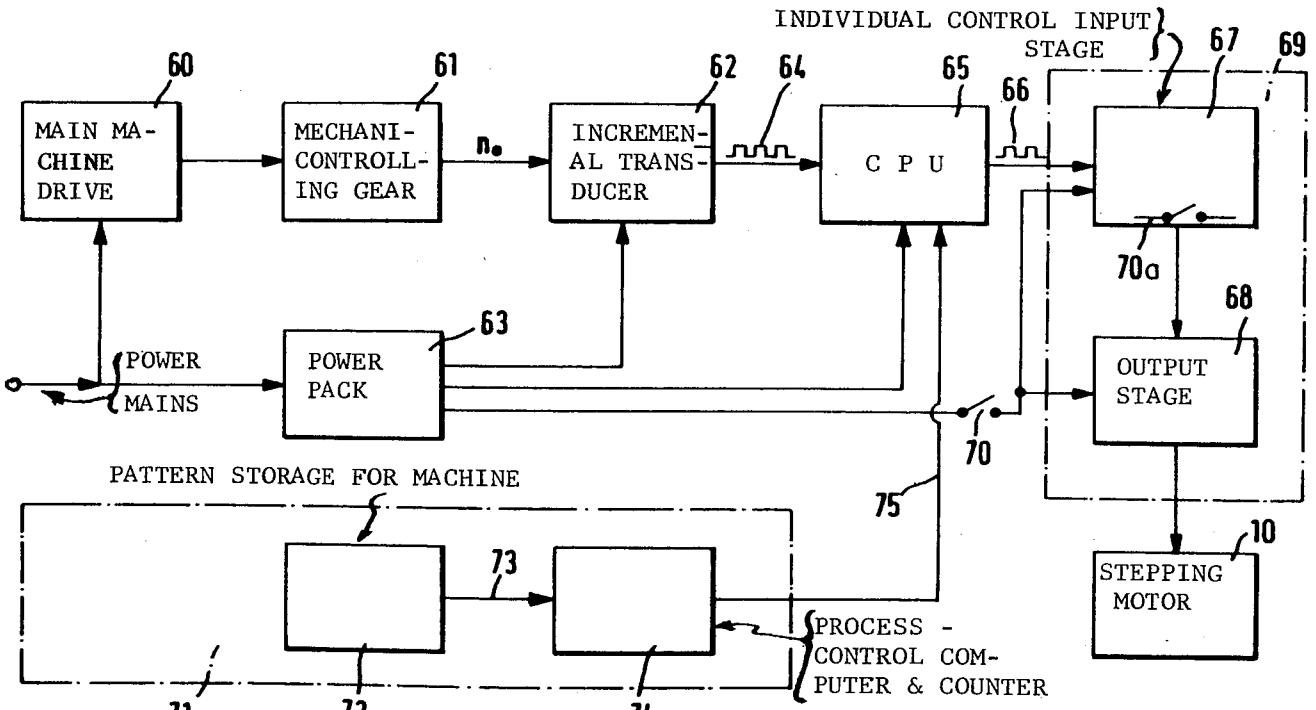

In the control circuit shown in FIG. 6, the main drive mechanism 60 supplied by mains power and for instance driving a circular knitting machine is coupled via a toothed gearing with a controlling gear 61, which enables an infinitely adjustable regulation of its initial speed. The controlling gear 61 drives an incremental transducer 62, which includes a transducer wheel rotating in a fixed dependency on the speed of the main drive 60; the transducer wheel is scanned electrooptically or electromagnetically. The incremental transducer, which is supplied with current by a power pack 63, emits at its output a pulse train 64 having the associated stepping frequency, which is supplied to a computer stage 65, which is also supplied with current from the power pack 63. The stepping pulse control signal 66 emitted at the output of the computer stage 65 is delivered to an input stage 67 of the associated yarn feeding apparatus, from whence, via an output stage 68, the stepping motor 10 is triggered. The input stage 67 and the output stage 68 are advantageously located on a printed circuit board 69, which is accommodated in the housing 37 of the associated yarn feeding apparatus.

The input stage 67 and/or output stage 68 may contain electric switching means 70 and/or 70a, which make it possible to shut off the stepping motor 10 by hand, either individually or centrally, or to bring about a stoppage of the machine under the control of the yarn feeler arms 32, 33 (FIG. 1). This shutoff of an individual yarn feeding apparatus—which may as needed also be effected from the computer stage 65—is also significant if for instance because of yarn breakage on the way between the yarn feeding apparatus and the yarn carrier, the goods should be cast off the needles partially or entirely. In that case, with the yarn feeding apparatus switched off, the needles can temporarily fetch their yarns themselves as needed, with the corresponding feed disk 14 simply being rotated idly, without changing the size of the yarn spool 26.

All the yarn feeding apparatuses, for instance for a circular knitting machine, can be connected in the described manner to the computer stage 65, thereby assuring, by electrical means, an absolutely synchronized operation of all the feed disks 14. By correspondingly regulating the controlling gear 61, the circumferential speed of all the feed disks 14 and thus the amounts of yarn delivered by all the yarn feeding apparatuses can be varied simultaneously by the same extent. The stepping motors assure an absolutely synchronized operation of all the feed devices triggered in common, because all the stepping motors execute exactly the same number of steps per revolution of the machine. During the starting and stopping phases of such machine, as well, synchronized operation of the stepping motors is maintained.

If there is a sudden failure of electrical current for the main drive 60 of the machine, the feed disks 14 continue to be driven in synchronism with one another during the unbraked stopping of the machine by the yarns which are wrapped about them and continue to be fetched by the needles of the individual knitting locations; thus an automatic yarn braking is brought about by the coercive forces of the permanent magnet systems of the individual stepping motors, which reliably precludes the feared condition in which individual yarn feeding apparatuses stop out of order and result in an excess or lack of yarn at individual knitting locations. For this reason, the stepping motors 10 are retained stably in their particular rotor position when the machine shuts down, although they can also be individually rotated by hand in both rotational directions arbitrarily, for instance in order to thread the yarn. Nevertheless the yarn feeding apparatuses are reliably protected against fluff and lint, for instance coming from a bad spool, while on the other hand in increased removal of yarn, for instance by an incorrectly set knitting system, is precluded because the stepping motors 10 develop so much torque that they cannot be rotated by the yarn.

The yarn feeding apparatuses can operate not only in the so-called positive mode of operation shown in FIG. 1, in which the speed of yarns **25, 25*a* approaching the feed disk 14 at a tangent is compulsorily identical to the speed of the yarn likewise leaving it at a tangent. If desired, the yarn feeding apparatuses may also be operated with an irregular consumption of yarn (so-called negative operation), to which end the delivery eyelets 30, 30*a* (FIG. 5) need merely be disposed such that the yarn 25 or 25*a* is unwound over head from the feed disk 14, which then, if need be, is formed as a feed drum. In this case, the stepping frequency of the voltage supplied to the stepping motor 10 of the individual yarn feeding apparatus is selected such that at least the maximum amount of yarn needed can be furnished. If the amount of yarn used drops, then the spool 26 of yarn located on the feed disk 14 increases in size, until under the control of an associated scanning device the stepping motor 10** is either shut off or switched over to a lower stepping frequency.

For special cases, it is also possible to have the yarn feeding apparatus operate as a so-called friction feedwheel. In this case, the stepping frequency of the voltage supplied to the stepping motor 10 is so high that an "oversupply" of the knitting system supplied by the yarn feeding apparatuses—assuming that the system was knitting with all needles—would occur. The yarn spool 26 has only a few windings, however, so slip-free feeding cannot occur; all that can occur is a frictional carrying along of the yarn, and this is dependent on the yarn tension at the time.

Given an appropriate embodiment of the control circuit shown in FIG. 6, the yarn feeding apparatus can also be used for circular knitting machines which are set up for producing circular striped patterns, or which are provided with edging attachments or are embodied as Jacquard machines. In this case, the control circuit includes a pattern switching element 71, which beginning with the pattern storage 72 emits pattern control commands via the line 73. The pattern storage 72 of the machine may be embodied in a known manner as a pattern wheel or drum, a punched card reader, a program memory, and so forth. The pattern control commands are delivered to a process-control computer 74, which performs the required signal conversion and via a line 75 delivers control commands and pattern information to the computer stage 65, which from these commands and this information, together with the stepping pulses 64, derives control signals 66 for the individual stepping motors 10.

In the so-called striping mode, that is, when producing circular stripes, the circular knitting machine is equipped with so-called striper attachments, which are switched in accordance with a pattern. Via the pattern control circuit 71, the yarn feeding apparatus associated with a given yarn is also switched on and off, together with the associated switchable yarn carrier, of which there are usually four pet striper attachment on each knitting system. Accordingly, four yarn feeding apparatuses of the kind described are provided per knitting location, of which only one at a time operates under the triggering control of the pattern storage 72. The incrementally correct drive by the stepping motors 10 becomes particularly significant here, because switching on and off of the yarn feeding apparatuses that is accurate for each needle is necessary. This can be attained by providing that the process-control computer 74 contains a corresponding number of freely programmable counting units, which are triggered from the pattern storage 72.

The counting units also make it possible to have two yarn feeding apparatuses operate in common via an exactly specified number of needles at the so-called changeover point (the location of yarn insertion and removal when changing yarn), so as thereby to attain an uninterrupted junction at the transition from one yarn to another.

Figure 5:
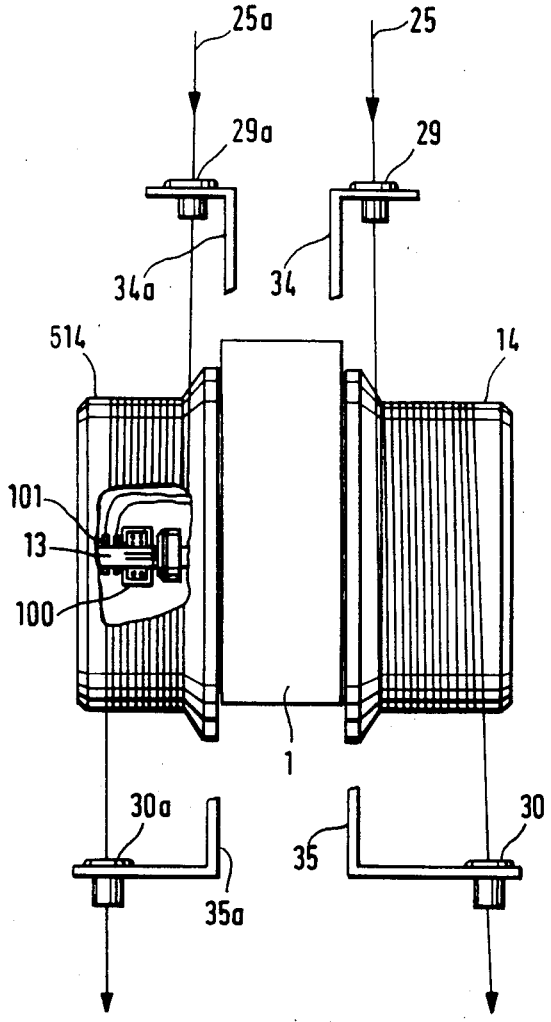

In the embodiment shown in FIG. 1, which in this case is equipped with two stepping motors 10 (one for each feed disk 14), the yarn 25 or **25*a* travels from the delivery eyelet, via the eyelet 310, 310*a* at the end of the yarn feeler arm 330 or 330*a*, to the stationary eyelet 311 or 311*a*, which may be disposed on the yarn feeler holder. As already explained, the flexible yarn feeler arms 330, 330*a* each control a switch located inside the housing at 37, for example by any suitable coupling or the like, shown schematically by broken line 130 to switch S, by means of which the stepping by means of which the stepping motor 10 is switched ON and OFF in accordance with the particular position of the yarn guide-and-feeler arm 330 or 330***a*. The operating position is shown in solid lines in FIG. 1, while the switched-off position is shown in broken lines. The electrical connection of switch S is shown at 70 and/or 70*a* in FIG. 6. In the embodiment of FIG. 5, switch S controls electromagnetic coupling 100. In a third position, the entire machine is shut off, for instance if the yarn should break. Yarn guide-and-feeler arm 330 can be selectively locked in operative position by any suitable and well known locking arrangement, shown schematically in broken lines 230.

In a circular knitting machine with purely mechanical striper attachment control, the following functions arise:

At the instant when a yarn change is taking place in a knitting feed, a new circular stripe yarn carrier inserts its yarn. A tensile force is exerted on this yarn, caused by the insertion movement of the circular stripe yarn carrier. As a result, the feeler arm 330 or 330*a* is moved together with the eyelet 310 or 310*a* into the operating position, shown in solid lines in FIG. 1; in this position the stepping motor 10 is switched on. The stepping motor 10 remains switched on until such time as the corresponding circular strip yarn carrier removes its yarn again, causing the yarn tension to decrease. As a result, the flexible feeler arm 330 or 330*a* can be moved by spring force into the switched OFF position corresponding to the yarn course indicated by broken lines; in this position, the associated stepping motor 10 is shut off.

Three different switch positions may be associated with the yarn feeler arm 330 or 330*a*, namely:

Position 1: stepping motor 10 (or coupling 100) ON; no shutoff of the machine.

Position 2: stepping motor 10 (or coupling 100) OFF; no shutoff of the machine.

Position 3: stepping motor 10 (or coupling 100) OFF; and shutoff of the machine.

In so-called edging operation, that is, when knitting edges, the yarn consumed during knitting of the length of the goods is different from that when knitting the beginning (the edge) of the goods. Since the stepping motors 10 of the yarn feeding apparatuses can be individually triggered, they are supplied with pattern control commands, derived from the pattern storage 72, such that they provide the required amount of yarn for a given type of knitting.

If edges are being knitted of the type that are worked with so-called added reinforcement yarns not knitted into the length of the goods itself, then these added reinforcement yarns are each delivered via positive-feeding yarn feedwheels 14 of the yarn feeding apparatuses, the stepping motors 10 or couplings 100 of which are switched on and off in accordance with the pattern; additional, expensive attachments would not be necessary.

When patterned or so-called Jacquard goods are being knitted, a positive yarn feeding again takes place, using the novel yarn feeding apparatuses. The pattern storage 72 contains the same pattern information with which the selection of needles at a given knitting location is also performed. From this pattern information, as already described, the stepping frequency required for controlling the individual stepping motors 10 or their couplings 100 is calculated in accordance with the pattern via the process-control computer 74 and the computer stage 65, so that the particular amount of yarn required is positively delivered in a highly accurate manner.

If it is assumed that each needle that is to form a loop in accordance with a pattern is allocated a certain yarn quantity X and for each needle not being used for knitting a yarn quantity Y is allocated (this is the amount of yarn required for yarn connection, or floating, to the next loop in a knitted row), then an absolutely uniform allocation of yarn can be effected in accordance with the pattern and in a positive manner. Bordering patterns and transitions to an edge can also be attained in a simple manner, because the delivery of yarn is effected analogously to the needle selection. The yarn quantity Y for each nonknitting needle is independent of the gauge of the goods and is thus constant, because the plating stitches from one needle stitch to the next and also the so-called yarn floatings are always of equal length. Hence when there is a change in quality only the amount of yarn consumed by the knitting needles changes; this is detected by the counting units of the process-control computer 74, which together with the computer stage 65 causes the stepping motor 10 of each yarn feeding apparatus to be allocated the required number of stepping pulses for the particular amount of yarn needed at a given time.

To vary the quality of the goods, all that is required is to vary the controlling gear 61, which can be done either when the machine is stopped or when it is in operation.

The yarn feeding apparatus can also be used for weft thread picking in weaving machines, warp knitting machines, Raschel machines and the like. The feed disk 14 that positively feeds the weft yarn can be controlled via the control circuit in accordance with the speed of the weft thread picking device (e.g., the gripper in a gripper loom) in such a manner that excessive peaks of tension in the weft thread while the weft thread is being inserted into the shed do not arise.

The yarn feeding apparatuses, in all the embodiments described herein, can be used not only in the immediate vicinity of the yarn using location of an associated machine, but also on stationary bobbin creels disposed beside the machine, and can thus be associated with the bobbins. Since each yarn feeding apparatus can be individually triggered via its stepping motor 10 and the stepping motors themselves assure an absolutely synchronized operation of the feed disks 14 of all the yarn feeding apparatuses, simple control cables to the centrally disposed unit having the associated control circuit are sufficient; this unit may for instance be accommodated on the yarn-using machine. In order to attain yarn travel routes of equal length in a circular knitting machine, the bobbin creels may be placed in a circle around the machine, in the form of segments of a circle.

We claim:

1. A yarn feeding apparatus for a yarn processing textile machine, such as a circular knitting machine, having a holder (1, 1') adapted for attachment to the machine; yarn guide monitoring means (27, 28, 29; 30, 31, 310, 311) secured to the machine for guiding and monitoring feed of yarn (25, 25*a*);

an electric motor (10) secured to said holder;

and at least one yarn feed element (14, 14', 514) feeding yarn, in a slip-free manner, from the circumference thereof to a yarn utilization position, wherein said electric motor is a stepping motor (10);

electric energy pulse supply means (60–66) are provided, for energizing the stepping motor to rotate at a predetermined speed; and supplying, continuously stepping motor supply pulse trains;

said at least one yarn feed element (14, 14', 514) is coupled, in driving relation, to the stepping motor;

the yarn guide and monitoring means (**27–29; 30–33, 310, 311, 330, 330*a*) include a movable yarn run-off yarn guide-and-feeler (330, 330*a*) located with respect to the yarn guide element to sense the tension condition of yarn being supplied from the yarn feed element to the yarn utilization position of the textile machine, said run-off yarn guide-and-feeler being assigned to the respective at least one feed element (14, 14', 514**) for guiding and monitoring yarn being fed and supplied thereby;

and switch means (S, **70, 70*a*) are provided, controlled by the run-off yarn guide-and-feeler (330, 330*a*), controlling, during operation of the textile machine, in an ON-OFF manner, as a function of sensed yarn being required by the sensed yarn being required by the textile machine at the yarn utilization position, selectively, either (a) interrupting of transmission of rotary power from the stepping motor to the feed element upon termination of requirement of yarn by the textile machine at the yarn utilization position, (b) continue transmission of rotary power from the stepping motor to the associated feed element (14, 14', 514**) as determined by said pulse supply means, upon requirement of yarn by the textile machine at the yarn utilization position.

2. The apparatus of claim 1, wherein the holder (1, 1') comprises a plate-like element, the at least one yarn feed element comprises two yarn feed elements (14, 14', 514), respectively located at opposite sides of the holder.

3. The apparatus of claim 1, wherein the at least one yarn feed element comprises two feed elements (14, 14', 514), driven in common by said stepping motor, said stepping motor having a shaft commonly coupled to said elements, said elements being located coaxially on the shaft;

and wherein a selectively engageable and disengeable coupling (100) is provided, selectively coupling the common shaft (13) to an associated feed element (514).

4. The apparatus of claim 3, wherein said selectively engageable coupling comprises an electrically controlled coupling (100), said electrically controlled coupling being selectively engaged and disengaged as controlled by the respective individual run-off yarn guide-and-feeler (**310, 330, 330*a*) assigned to the respective feed element (514**).

5. The apparatus of claim 1, wherein the at least one yarn feed elements comprises two yarn feed elements (14, 14', 514), each yarn feed element has an individual stepping motor, each motor having a shaft permanently coupled to a yarn feed element, an additional individual run-off yarn guide-and-feeler (**330*a*) is provided, and driving connection to the respective feed element is controlled by the switch means (S, 70, 70*a*) under control of the respective individual run-off yarn guide-and-feeler (330, 330*a***) assigned to the associated feed element.

6. The apparatus of claim 1, wherein the stepping motor is located within the at least one yarn feed element (14);

and the yarn feed element is formed with ventilation openings (16, 17) to provide for passage of cooling air to flow therethrough and to cool said stepping motor.

7. The apparatus of claim 6, wherein the yarn feed element (14) comprises a drum structure; and the drum structure includes fan means to provide for forced air circulation towards the interior of the drum structure.

8. The apparatus of claim 6, further including a dust screen (21) screening at least one of the ventilation openings.

9. The apparatus of claim 6, further including air guide means (18) for directing cooling air flow to the stepping motor (10).

10. The apparatus of claim 6, wherein the holder (1, 1') is formed with at least one airflow opening (170) communicating with the interior of the at least one feed element (14) and to provide for passage of cooling air therethrough.

11. The apparatus of claim 10, further comprising air hose means (**170*a*) coupled to an outlet from said air flow opening (170**), and leading to a utilization device for compressed air.

12. The apparatus of claim 1, including means (**11*a*, 40) adjustably securing the at least one yarn feed element (14) on the holder (1, 1'**).

13. The apparatus of claim 12, further including position sensing switch means for sensing the position of the yarn feed element (14) on the holder.

14. The apparatus of claim 12, wherein the position adjustment means are located with respect to the holder to adjust the position of the yarn feed element, and hence of the stepping motor (10) coupled thereto to change the position of the stepping motor, selectively, while retaining the axis of the stepping motor in the same plane.

15. The apparatus of claim 1, wherein said yarn guide and monitoring devices (27, 28, 29; 30, 32, 33; 310, 311) comprise a first group of run-out yarn guide elements (33) secured to said holder, and controlling the direction of yarn being delivered from said feed element (14, 14', 514);

and said movable yarn run-off yarn guide-and-feeler (**330,330*a*) individually assigned to the respective feed element is movably retained on said holder (1, 1'**).

16. The apparatus of claim 15, wherein the movable yarn run-off yarn guide-and-feeler (**330, 330*a***) can be locked in a predetermined position.

17. The apparatus of claim 15, wherein the movable yarn run-off yarn guide-and-feeler (**330, 330*a*) includes a flexible yarn feeler arm (330), said flexible yarn feeler arm being coupled to control operation of said switch means (S, 70, 70*a***).

18. The apparatus of claim 1, wherein said switch means includes a textile machine stop-motion switch, and said movable yarn run-off yarn guide-and-feeler (**330, 330*a***) is coupled to operate said switch means for, additionally, selectively controlling the stop motion switch to stop the machine upon sensing of absence of yarn.

19. The apparatus of claim 1, wherein at least two separate yarn guide and monitoring devices (33, 330; 33*a*, 330*a*) are associated with each feed element.

20. The apparatus of claim 1, including means (11a, 40) adjustably securing the at least one feed element (14) on the holder (1, 1');

and further including two commonly adjustable yarn guide elements (45, 46) associated with each feed element (14, 14', 514), said commonly adjustable yarn guide elements including feed guide means (47, 48) engaging the yarn, said feed guide means being individually adjustable.

21. The apparatus of claim 20, including pivotable arms forming the movable yarn guide elements, the feed guide means being located at terminal positions of said pivotable arms, said pivotable arms being pivotable about a common axis.

* * * * *